United States Patent [19]

Imoto et al.

[11] Patent Number: 4,615,318

[45] Date of Patent: Oct. 7, 1986

[54] IGNITION APPARATUS FOR INTERNAL COMBUSTION ENGINE

[75] Inventors: Kosuke Imoto, Shiki; Hiroshi Katada, Katsuta, both of Japan

[73] Assignees: Hitachi, Ltd; Honda Giken Kogyo Kabushiki Kaisha, both of Tokyo, Japan

[21] Appl. No.: 781,556

[22] Filed: Sep. 30, 1985

[30] Foreign Application Priority Data

Oct. 6, 1984 [JP] Japan ..... 59-210289

[51] Int. Cl.[4] ..... F02P 5/04

[52] U.S. Cl. ..... 123/414; 123/612; 123/618

[58] Field of Search ..... 123/414, 612, 618, 416, 123/418, 480; 364/200

[56] References Cited

U.S. PATENT DOCUMENTS

| | | | |
|---|---|---|---|
| 4,353,341 | 10/1982 | Henning | 123/414 |
| 4,414,946 | 11/1983 | Daumer et al. | 123/414 |
| 4,519,362 | 5/1985 | Arakawa et al. | 123/414 |
| 4,520,781 | 6/1985 | Nishida | 123/414 |

*Primary Examiner*—Raymond A. Nelli

*Attorney, Agent, or Firm*—Pollock, Vande Sande and Priddy

[57] ABSTRACT

An ignition apparatus for an internal combustion engine includes means for generating signals indicating when the crankshaft and camshaft of the engine have respectively reached predetermined angular positions, a command circuit for initiating and terminating ignition operation in response to these position signals, and means for establishing a first operating condition, following each camshaft position pulse, in which the ignition operation is enabled and a second operating condition, following a subsequent crankshaft position pulse, in which ignition operation is inhibited, to thereby eliminate redundant ignition operation and the attendant power loss and heat generation. The apparatus also includes a timer circuit which act to enable resetting to the second operating condition by the crankshaft position pulses only during a fixed time interval following each cam shaft position pulse, in order to ensure stable operation when operating at very low engine speeds.

4 Claims, 2 Drawing Figures

IGNITION APPARATUS FOR INTERNAL COMBUSTION ENGINE

BACKGROUND OF THE INVENTION

The present invention relates to an improved ignition apparatus for an internal combustion engine, of the type which does not employ a distributor. Various forms of ignition apparatus which do not incorporate a distributor are known in the prior art, e.g. as described in Japanese patents 58-19853 and 58-57631. Generally, to achieve a high degree of accuracy of ignition timing control with such prior art types of ignition apparatus, ignition signal pulses are generated by detecting when the crankshaft of the engine has reached specific angles of rotation, with this detection being performed by utilizing a pulse generating transducer (referred to in the following specification and claims by the term "pulser") having a rotor which is fixedly mounted directly on the crankshaft. Thus, for each cylinder of the engine, an ignition signal pulse will be generated once in each revolution of the crankshaft, with an ignition spark being thereby generated. As a result, for each desired ignition spark which is generated, one redundant ignition spark will be produced, i.e. occurring each time the piston is in the region of the top dead center position following an exhaust stroke. The generation of these redundant ignition sparks results in an increased level of power dissipation in the ignition coil, and increased heat dissipation by the coil. This is especially true when a "high energy" type of ignition coil is utilized. It therefore becomes necessary to use a larger size of ignition coil, in order to ensure that the rate of heat dissipation from the coil will be sufficient. This prevents the overall ignition system from being made lightweight and compact.

SUMMARY OF THE INVENTION

It is an objective of the present invention to provide an ignition apparatus for an internal combustion engine which will eliminate the disadvantage of prior art types of ignition apparatus which do not employ a distributor, i.e. the generation of redundant ignition sparks as described above, and in particular an ignition apparatus which will provide completely stable operation even when the crankshaft of the internal combustion engine is rotating at very low speed, such as at a time immediately following starting of the engine. In order to achieve this objective, such an apparatus basically comprises crankshaft position pulse generating means for detecting when the crankshaft of the internal combustion engine has rotated to a predetermined angular position and for generating corresponding crankshaft position pulses, camshaft position pulse generating means for detecting when the camshaft of the engine has rotated to a predetermined angular position and for generating corresponding camshaft position pulses, command signal generating means coupled to receive the crankshaft position pulses, for generating ignition command signals in response thereto, and an ignition circuit for passing a current through an ignition coil and interrupting this current to produce a high ignition voltage at timings determined by the ignition command signals.

The apparatus also includes enabling means which are responsive to the camshaft position pulses and crankshaft position pulses for being set at appropriate timings to a first operating state in which operation of the ignition circuit in response to the ignition command signals is enabled, and a second operating state in which such ignition circuit operation is inhibited. The enabling means include timer means whereby setting to the latter sound operating state in response to the crankshaft position pulses is only enabled during periodic time intervals of fixed duration.

More specifically, the enabling means comprise an enabling signal generating circuit for selectively inhibiting and enabling operation of the ignition circuit in response to the crankshaft position pulses and the camshaft position pulses. The enabling signal generating circuit is set to the first operating conditions in response to each camshaft position pulse, whereby the ignition circuit is enabled to generate high ignition voltages. When the succeeding crankshaft position pulse occurs, following an interval which is referred to in the specification as a first enabling interval, the enabling signal generating circuit is set in the second operating condition, in which generation of high ignition voltages by the ignition circuit is inhibited. This condition continues until the next first enabling interval begins.

The apparatus also comprises a timer control circuit for controlling the transfer of the crankshaft position pulses to the enabling signal generating circuit, i.e. to selectively inhibit or enable the resetting of the enabling signal generating circuit by these pulses to the second operating condition mentioned above. The timer control circuit enables transfer of the crankshaft position pulses to the enabling signal generating circuit only during a time interval of fixed duration following each of the crankshaft position pulses, referred to in the specification as a second enabling interval.

DESCRIPTION OF THE PREFERRED EMBODIMENTS

Figure 1:
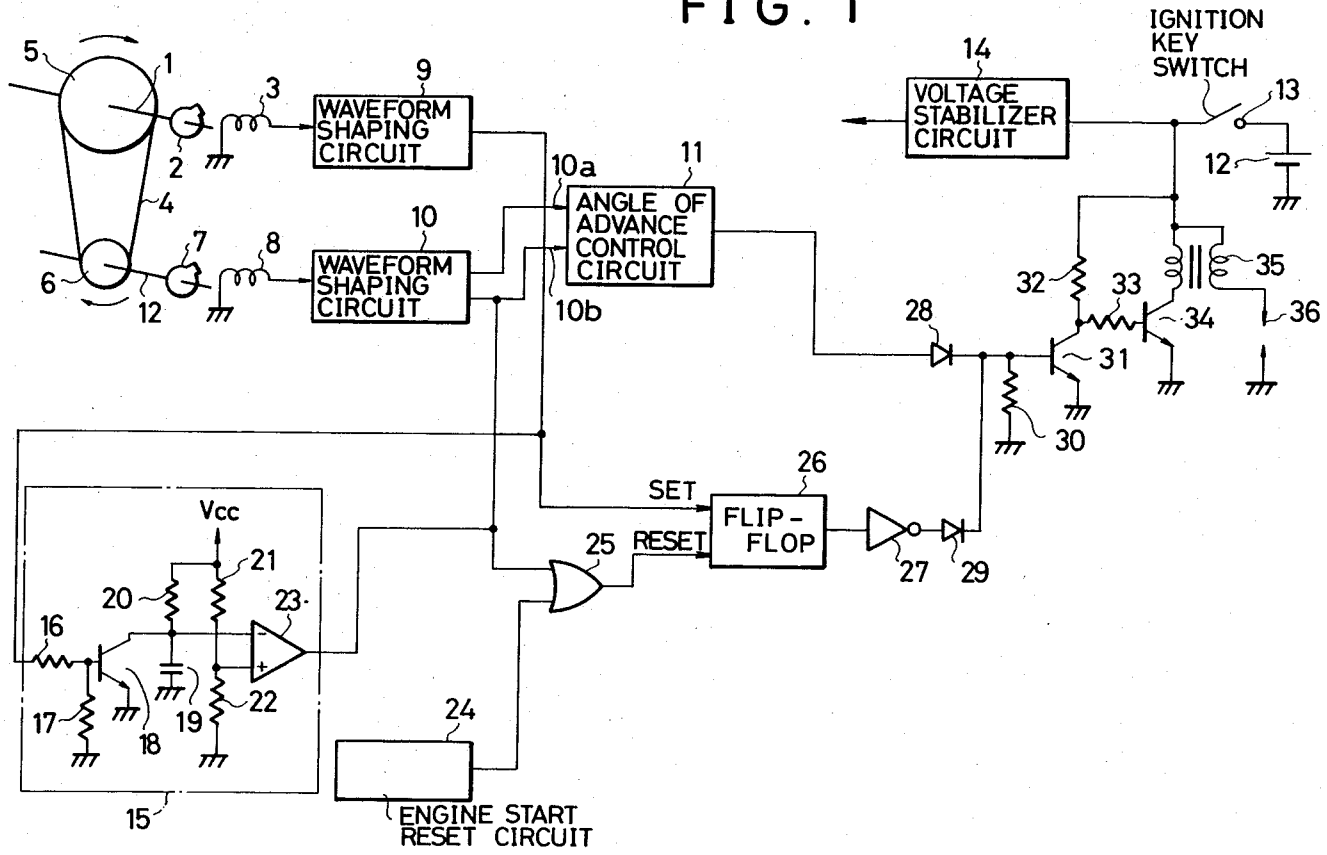
FIG. 1 is a circuit diagram of an embodiment of an ignition apparatus according to the present invention.
Figure 2:
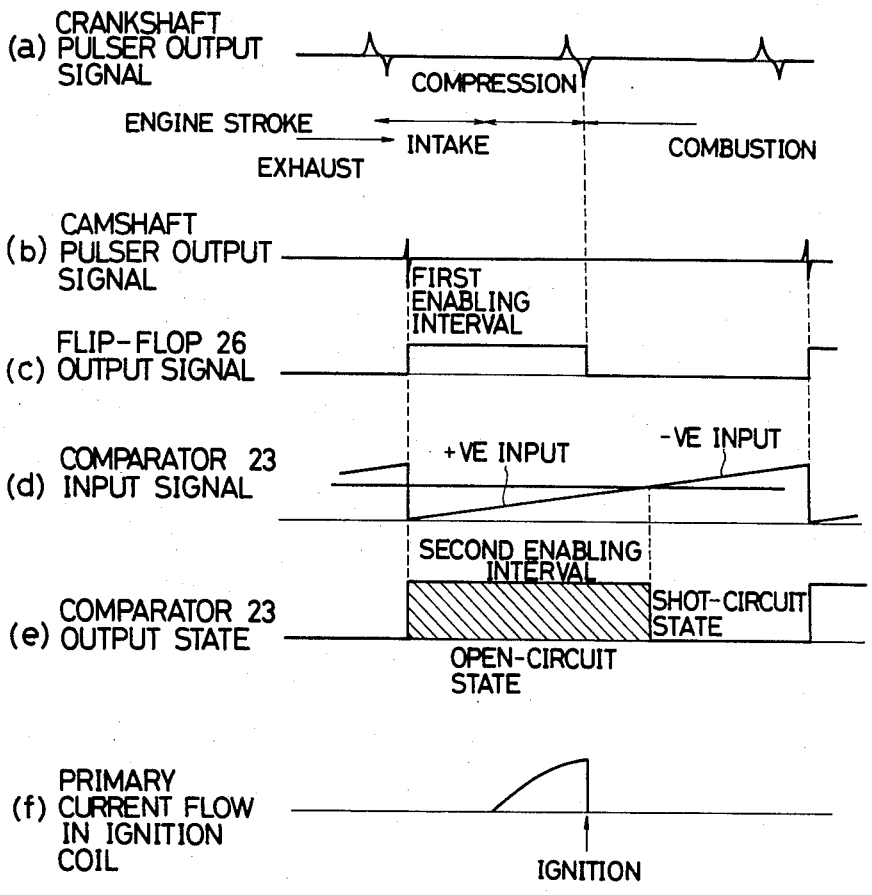
FIG. 2(*a*) to 2(*f*) are waveform diagrams to illustrate the operation of the embodiment of FIG. 1.

Referring first to FIG. 1, a circuit diagram is shown of an embodiment of an ignition apparatus according to the present invention. For simplicity of description, an ignition apparatus for a single-cylinder internal combustion engine (not shown in the drawings) is described. FIG. 2(*a*) to 2(*f*) are waveform diagrams for illustrating the operation of the circuit of FIG. 1. Numeral 1 denotes the cam shaft of the internal combustion engine, having a cam shaft sprocket 5 fixedly mounted thereon. The cam shaft 1 is driven at $\frac{1}{2}$ the speed of rotation of the crankshaft 12 of the internal combustion engine, by a sprocket chain 4 which couples the camshaft sprocket 5 to a crankshaft sprocket 6 mounted on crankshaft 12. Numeral 2 denotes a pulser rotor of a camshaft pulser 3, while numeral 7 denotes a pulser rotor of a crankshaft pulser 8, with pulser rotors 2 and 7 being fixedly mounted directly on camshaft 1 and crankshaft 12 respectively. The camshaft pulser 3 thereby generates camshaft position pulses in correspondence with angular positions of camshaft 1, and crankshaft pulser 8 similarly produces crankshaft position pulses in correspondence with angular positions of crankshaft 12. In the present embodiment, crankshaft pulser 8 produces a pair of pulses of mutually opposite polarity when the crankshaft reaches an initial ignition position and a position close to the maximum angle of advance, respectively. Numerals 9 and 10 denote waveform shaping circuits which perform waveform shaping and amplification of the pulses output from pulsers 3 and 8 respectively. In addition, waveform shaping circuit 10 performs separation of "initial ignition position" pulses and "maximum angle of advance position" pulses from the pairs of pulses referred to above, and outputs these two trains of pulses on respectively different output signal lines, designated as 10*a* and 10*b*, which are coupled to inputs of an electronic advancement control circuit 11, which constitutes a command signal generating circuit for generating ignition command signals to control the initiation and termination of current flow in the ignition coil in order to execute each ignition operation and generate a high ignition voltage. The configuration and operation of electronic advancement control circuit 11 can be similar to examples of such circuits which are well known in the art, e.g. as described in Japanese patents Nos. 58-19853 and 58-57631, and so no description of this circuit will be given herein. Control circuit 11 is responsive to the "initial ignition position" and "maximum angle of advance position" pulse signals referred to above for producing an output signal which controls the initiation and termination of current flow in the primary of an ignition coil, as described hereinafter, to produce ignition.

Numeral 12 denotes a vehicle battery which constitutes the power source for the ignition apparatus. The voltage of battery 12 is transferred through an ignition key switch 13 to a voltage stabilizer circuit 14 which supplies stabilized voltages to the circuits.

Numeral 24 denotes an "engine start reset" circuit which produces an output signal, when the starter switch of the engine is actuated, that is transferred through an OR gate 25 to a reset input of a flip-flop 26, to thereby determine an initial status of flip-flop 26 as described hereinafter. The cam shaft position pulses which are output from camshaft pulser 3 as described hereinabove are applied to a set input of flip-flop 26.

The "initial ignition position" pulses from waveform shaping circuit 10 are also applied through OR gate 25 to the reset input of flip-flop 26. An output signal thereby produced from flip-flop 26 is inverted by an inverter 27, with the inverted signal being transferred through a diode 29 to be combined with the output signal from angle of advance control circuit 11, which is transferred through diode 28. The combined signals thus produced are applied to the base of a driver transistor 31 which drives a power transistor 34. In the following, a time interval during which flip-flop 26 is in the set state, so that a high (positive) logic level output is produced therefrom, will be referred to as a first enabling interval. A resistor 30 serves to stabilize the current flow into the base of driver transistor 31, while resistors 32 and 33 serve to supply base current to transistor 34. The primary of an ignition coil 35 is connected between the collector of transistor 34 and the output from key switch 13, while the secondary of ignition coil 35 is connected to a spark plug 36.

During a first enabling interval, in which a high (positive) level output is produced from inverter 27 as illustrated in FIG. 2(*c*), driver transistor 31 is held in a saturated operating state, so that transistor 34 will be held in the off state, and no current can flow through transistor 34 to produce ignition even if an output pulse is produced by control circuit 11. Thus, generation of ignition voltage by the ignition coil 35 can only occur during each first enabling interval. When the internal combustion engine is started, the speed of rotation of crankshaft 12 will be reduced during each compression stroke, and the level of peak pulse output from pulser 8 will be accordingly decreased. Thus, the resultant level of pulses output from waveform shaping circuit 10 may not be sufficiently high for proper operation of the circuit. This condition may result in redundant ignition operation taking place during an exhaust stroke of the engine. In order to prevent such an occurrrence during low-speed rotation of the engine, a second enabling signal generating circuit 15 is provided, which operates on the basis of elapsed time.

In circuit 15, a transistor 18 together with resistors 16 and 17 constitute a discharge circuit for discharging a capacitor 19 in response to each output pulse from waveform shaping circuit 9 of camshaft pulser 3. Charging of capacitor 19 takes place through a resistor 20, so that a sawtooth waveform appears across capacitor 19, which is applied to the inverting input of a comparator 23. A voltage detection threshold level is established at the junction of two resistors 21 and 22, which is applied to the non-inverting input of comparator 23. Comparator 23 is selected to be of a type whereby the output terminal of the comparator is held in an effectively open-circuit condition so long as the potential applied to the non-inverting input of the comparator is lower than that applied to the inverting input, and whereby the comparator output terminal is short-circuited to ground potential (which in this embodiment corresponds to the low logic level potential) when the potential of the non-inverting input becomes higher than that of the inverting input. It can thus be understood that after each camshaft position pulse is input to circuit 15 from waveform shaping circuit 9, output line 10*b* of waveform shaping circuit 10 will be connected to ground potential (thereby inhibiting input of the "initial ignition position" pulse signal to the reset terminal of flip-flop 26 through OR gate 25) and will remain in that condition until a fixed time interval has elapsed, i.e. until the voltage on capacitor 19 rises to the threshold level. In this way, ignition operation is enabled only during a fixed time interval following each output pulse from camshaft pulser 3. Such a fixed time interval will be referred to in the following as a second enabling interval.

The operation of the circuit of FIG. 1 will now be described in greater detail, referring to the waveform diagrams of FIG. 2(*a*) to 2(*d*). FIG. 2(*a*) shows the crankshaft position pulses produced by crankshaft pulser 8. The positive-going pulses of this signal correspond to the initial ignition positions, while the negative-going pulses correspond to the positions of maximum angle of advance. FIG. 2(*b*) shows the output pulses from camshaft pulser 3, with each of these pulses being produced during an intake stroke of the internal combustion engine. The point at which each of these pulses is generated must be between a position which is prior to that at which conduction by transistor 34 must be initiated to begin an ignition operation when the engine is operating at a high speed of rotation and subsequent to that at which the immediately preceding initial ignition position pulse is produced by crankshaft pulser 8. FIG. 2(*c*) shows the output signal from flip-flop 26. This signal can only be set at the high logic level (i.e. to establish a first enabling interval) during a second enabling interval, which is determined by circuit 15 as described hereinabove, that is to say while the output of comparator 23 is in the open-circuit, i.e. floating, state which is maintained for a fixed time interval following each output pulse from the camshaft pulser 3.

FIG. 2(*f*) shows the flow of current in the primary of ignition coil 36, which is initiated and terminated by an output signal from advancement control circuit 11, i.e. a low-logic level state of the output from control circuit 11 during which drive transistor 31 is set in the open-circuit state so that output transistor 34 is set in the on, i.e. conducting, state. It will be apparent that this can only occur during an interval in which the output from flip-flop 26 is at the high logic level, i.e. during a first enabling interval which occurs within a second enabling interval. Such a condition can only occur at an appropriate timing for ignition to be initiated, i.e. during a compression stroke of the engine.

If the speed of rotation of the engine is so low that the level of an output pulse from crankshaft pulser 8 is insufficient to cause reset of flip-flop 26 after this has been set by the preceding camshaft pulser output pulse, flip-flop 26 will remain in the set state (with a high logic level output being produced thereby) until the next output pulse from crankshaft pulser 8 occurs which is of sufficiently high level to cause reset of flip-flop 26. However in such a case, any redundant output signals produced by control circuit 11 in response to a camshaft pulser output pulse will not result in an ignition operation being initiated, since at such a time, comparator 23 will function as described to inhibit transfer of a reset pulse from waveform shaping circuit 10 to flip-flop 26, i.e. such a redundant output signal would not be produced during a second enabling interval. Thus no redundant ignition current flow will take place in output transistor 34 (i.e. during an exhaust stroke) in such a case. This will be true even if the engine starter switch is momentarily actuated and and then released, so that the engine speed attains a very low value.

From the above description it can be understood that a ignition apparatus according to the present invention provides very stable operation, with freedom from unnecessary power dissipation and resultant heating of the ignition coil due to generation of spurious ignition sparks during exhaust strokes, even when the engine is rotating at low speed, and during the time immediately after starting of the engine has been executed. It can also be understood that such a ignition apparatus can have a very simple configuration.

It will be apparent that various other specific circuit arrangements could be utilized to perform the functions of an ignition apparatus according to the present invention as described above. Thus, although the present invention has been described in the above with reference to a specific embodiment, various changes and modifications to the embodiment may be envisaged, which fall within the scope claimed for the invention as set out in the appended claims. The above specification should therefore be interpreted in a descriptive and not in a limiting sense.

What is claimed is:

1. An ignition apparatus for an internal combustion engine having a crankshaft and a camshaft coupled to said crankshaft to be rotated thereby, comprising:

crankshaft position signal generating means for detecting that said crankshaft has rotated to a predetermined angular position and for generating crankshaft position signals in response to said detection;

camshaft position signal generating means for detecting that said camshaft has rotated to a predetermined angular position and for generating camshaft position signals in response to said detection;

command signal generating means coupled to receive said crankshaft position signals, for generating ignition command signals in response to said crankshaft position signals;

ignition circuit means for generating a high ignition voltage in response to said ignition command signals;

enabling signal generating circuit means coupled to control said ignition circuit means, and coupled to receive said crankshaft position signals and said camshaft position signals, and adapted to be set to a first operating condition in response to said camshaft position signals whereby generation of said high ignition voltage by said ignition circuit means is enabled, and to be reset to a second operating condition in response to said crankshaft position signals whereby said generation of said high ignition voltage by said ignition circuit means is inhibited, and;

timer control circuit means adapted to control the transfer of said crankshaft position signals to said enabling signal generating circuit means, said timer control circuit means being responsive to said crankshaft position signals for enabling resetting of said enabling signal generating circuit means to said second operating state by said crankshaft position signals only during a time interval of fixed duration following each of said crankshaft position signals.

2. An ignition apparatus according to claim 1, and further comprising means for generating a signal when starting of said internal combustion engine is initiated, and for applying said signal to said enabling signal generating circuit means such as to establish said second operating condition of said enabling signal generating circuit means in which said high ignition voltage generation is inhibited.

3. An ignition apparatus according to claim 1, in which said enabling signal generating circuit means comprise a flip-flop which is coupled to be set and reset by said camshaft position signals and said crankshaft position signals respectively.

4. An ignition apparatus according to claim 1, in which said timer control circuit means comprise a capacitor, a source of a charging current for said capacitor, a circuit for discharging said capacitor in response to each of said camshaft position signals, and comparator circuit means for detecting when a voltage across said capacitor is below a predetermined threshold voltage level as a result of said discharging and for enabling transfer of said crankshaft position signals to said enabling signal generating circuit means only while said capacitor voltage is below said threshold level.

* * * * *